US011677129B2

(12) United States Patent
Stace et al.

(10) Patent No.: US 11,677,129 B2
(45) Date of Patent: Jun. 13, 2023

(54) MICROWAVE CIRCULATOR

(71) Applicant: THE UNIVERSITY OF QUEENSLAND, St Lucia (AU)

(72) Inventors: Thomas Michael Stace, Auchenflower (AU); Clemens Wolfgang Müller, Zurich (CH)

(73) Assignee: THE UNIVERSITY OF QUEENSLAND, St Lucia (AU)

( * ) Notice: Subject to any disclaimer, the term of this patent is extended or adjusted under 35 U.S.C. 154(b) by 0 days.

(21) Appl. No.: 17/602,123

(22) PCT Filed: Apr. 8, 2019

(86) PCT No.: PCT/AU2019/050312

§ 371 (c)(1),
(2) Date: Oct. 7, 2021

(87) PCT Pub. No.: WO2019/195881

PCT Pub. Date: Oct. 17, 2019

(65) Prior Publication Data

US 2022/0166120 A1 May 26, 2022

(30) Foreign Application Priority Data

Apr. 9, 2018 (AU) ..... 2018901164
Apr. 9, 2018 (AU) ..... 2018901166
May 4, 2018 (AU) ..... 2018901522

(51) Int. Cl.
*H01P 1/397* (2006.01)

(52) U.S. Cl.
CPC ..... *H01P 1/397* (2013.01)

(58) Field of Classification Search
CPC .. H01P 1/397; H01P 1/32; H01P 1/393; H01P 1/38; H01P 1/36; G06N 10/00; G06N 10/20; H10N 60/12; H10N 60/805
See application file for complete search history.

(56) References Cited

U.S. PATENT DOCUMENTS 4,801,901 A * 1/1989 Ayasli ..... H01P 1/397 333/1.1
9,806,711 B1 10/2017 Abdo
2018/0287041 A1* 10/2018 Abdo ..... G06N 10/00

FOREIGN PATENT DOCUMENTS

WO 2016/138406 9/2016

OTHER PUBLICATIONS

International Preliminary Report on Patentability and Written Opinion of the International Searching Authority dated Sep. 28, 2021, issued in International Application No. PCT/AU2019/050312, 4 pages.

(Continued)

*Primary Examiner* — Stephen E. Jones
(74) *Attorney, Agent, or Firm* — Nixon & Vanderhye P.C.

(57) ABSTRACT

A microwave circulator including an integrated circuit having a number of ports and a respective ring segment coupled to each port to allow microwave frequency signals to be transferred between the port and the respective ring segment. The circulator includes multiple respective ring segments arranged to define multiple parallel circulator rings and at least one superconducting tunnel junction interconnecting each pair of adjacent ring segments and/or a plurality of superconducting tunnel junctions interconnecting each pair of adjacent ring segments to form a circulator ring. The ring segments are configured so that when a bias is applied to the tunnel junctions, signals undergo a phase shift as they traverse the tunnel junctions between ring segments, thereby propagating signals to an adjacent port in a propagation direction.

55 Claims, 9 Drawing Sheets

(56) References Cited

OTHER PUBLICATIONS

International Search Report for PCT/AU2019/050312, dated May 13, 2019, 3 pages.
Written Opinion of the ISA for PCT/AU2019/050312, dated May 13, 2019, 4 pages.

* cited by examiner

MICROWAVE CIRCULATOR

This application is the U.S. national phase of International Application No. PCT/AU2019/050312 filed 8 Apr. 2019, which designated the U.S., the entire contents of which is hereby incorporated by reference.

BACKGROUND OF THE INVENTION

The present invention relates to a microwave circulator, and in particular an on-chip microwave circulator with a substantially high bandwidth response and/or a substantially linear response.

DESCRIPTION OF THE PRIOR ART

The reference in this specification to any prior publication (or information derived from it), or to any matter which is known, is not, and should not be taken as an acknowledgment or admission or any form of suggestion that the prior publication (or information derived from it) or known matter forms part of the common general knowledge in the field of endeavour to which this specification relates.

A microwave circulator is a passive non-reciprocal three- or four-port device, in which a microwave or radio frequency signal entering any port is transmitted to the next port in rotation (only). A port in this context is a point where an external waveguide or transmission line (such as a microstrip line or a coaxial cable), connects to the device. Thus, for a three-port circulator, a signal applied to port 1 only comes out of port 2; a signal applied to port 2 only comes out of port 3; a signal applied to port 3 only comes out of port 1.

Microwave circulators are ubiquitous in experiments on superconducting quantum circuits. They are used for routing signals, and to isolate the sensitive quantum devices from the relatively high-power control and readout circuitry. Commercially available circulators are wave-interference devices based on the Faraday effect, which requires relatively strong permanent magnets to break time-reversal symmetry. Their size and the necessary strong magnetic fields both make them unsuited to large-scale integration with superconducting circuits, generating a major bottleneck for the further scaling-up of superconducting quantum technology.

Recent work has seen a number of proposals to overcome these challenges. Many are based on non-linear mixing phenomena, or an engineered interplay of driving and dissipation. This class of circuits usually require additional microwave circuits and rely on careful engineering of phase relations between several input and drive fields.

"A passive on-chip, superconducting circulator using rings of tunnel junctions" by Clemens Müller, Shengwei Guan, Nicolas Vogt, Jared H. Cole, Thomas M. Stace, 28 Sep. 2017 arXiv:1709.09826 describes a passive, on-chip microwave circulator based on a ring of superconducting tunnel junctions. A constant bias is applied to the centre of the ring to provide the symmetry breaking magnetic field. The design provides high isolation even when taking into account fabrication imperfections and environmentally induced bias perturbations and has a bandwidth in excess of 500 MHz for realistic device parameters.

However, such arrangements typically suffer from practical limitations, which in turn impact on the commercial potential of the device. In particular the device has a strong non-linearity, which in practice will limit the power of any signal to be circulated to small values. Additionally, the device shows a limited bandwidth and is highly sensitivity to perturbations in external bias parameters.

SUMMARY OF THE PRESENT INVENTION

In one broad form, an aspect of the present invention seeks to provide a microwave circulator including an integrated circuit having: a number of ports; multiple respective ring segments coupled to each port to allow microwave frequency signals to be transferred between the port and the respective ring segments, the multiple ring segments being arranged to define multiple parallel circulator rings; and, at least one superconducting tunnel junction interconnecting each pair of adjacent ring segments in a circulator ring, wherein the tunnel junctions are configured so that when a bias is applied to the tunnel junctions, signals undergo a phase shift as they traverse the tunnel junctions between ring segments, thereby propagating signals to an adjacent port in a propagation direction, and wherein the circulator rings propagate signals having different frequency ranges.

In one embodiment the circulator includes: at least two circulator rings; at least three circulator rings; at least five circulator rings; and, at least ten circulator rings.

In one embodiment the propagation direction is dependent on at least one of a magnitude and polarity of the bias.

In one embodiment the bias includes: a central bias applied to all of the tunnel junctions; and, a segment bias applied to tunnel junctions each ring segment.

In one embodiment the bias includes at least one of a magnetic or electric field.

In one embodiment each port is coupled to at least one of the multiple respective ring segments at least one of: capacitively; inductively; and, using a superconducting tunnel junction.

In one embodiment each port is coupled to a first ring segment, and wherein the other ring segments are coupled to the first ring segment at least one of: capacitively; inductively; and, using a superconducting tunnel junction.

In one embodiment each circulator ring has at least one of: a different configuration; a different configuration of tunnel junctions; tunnel junctions having different properties; and, different biases.

In one embodiment the circulator rings are at least partially coupled.

In one embodiment the tunnel junctions provide at least one of: a specific inductance; and, a specific capacitance.

In one embodiment the tunnel junctions are at least one of: Josephson junctions; and, quantum phase slip junctions.

In one embodiment: the tunnel junctions are Josephson junctions; the ports and ring segments are capacitively coupled; the tunnel junctions introduce a specific capacitance between ring segments; and, the bias includes a magnetic field bias.

In one embodiment the tunnel junctions are Josephson junctions including superconducting electrodes separated by a tunnelling barrier, and wherein the junction has a cross sectional area of at least one of: at least 20 $nm^2$; less than 500 $nm^2$; less than 150 $\mu m^2$; and, about 100 $nm^2$.

In one embodiment the tunnel junctions are Josephson junctions and the current density is at least one of: between 20 and 200 $A/m^2$; and, between $0.2\times10^8$ and $4\times10^8$ $A/m^2$.

In one embodiment the integrated circuit includes: a substrate; a first superconducting film provided on the substrate that is to form a lower electrode of each Josephson junction; an insulating layer provided on at least part of the first conductive film that forms the Josephson tunnelling barrier of the Josephson junctions; and, a second superconducting film spanning the insulating layer on adjacent lower electrodes to form counter electrodes of each Josephson junction.

In one embodiment at least one of: the superconducting films are made of at least one of: niobium; and, aluminium; and, the insulating layer is made of aluminium oxide.

In one embodiment the bias includes: a central bias generated by applying a magnetic field to the ring; and, a segment bias generated by applying a bias voltage to each ring segment.

In one embodiment: the tunnel junctions are quantum phase slip junctions; the ports and ring segments are inductively coupled; the tunnel junctions introduce a specific inductance between ring segments; and, the bias includes a charge bias.

In one embodiment the tunnel junctions are quantum phase slip junctions including nanoscale width conductors extending radially to a central island.

In one embodiment the nanoscale width conductors include a section having a width of at least one of: greater than 10 nm; less than 100 nm; and, about 40 nm.

In one embodiment the bias includes: a central charge bias generated by applying a bias voltage to the central island; and, a segment bias generated by applying a bias magnetic field to each ring segment.

In one embodiment the tunnel junctions are quantum phase slip junctions including Josephson junctions in series with one or more inductors.

In one embodiment the circulator includes at least three ports and three ring segments.

In one embodiment a plurality of superconducting tunnel junctions interconnect each pair of adjacent ring segments in at least one circulator ring, wherein the plurality of tunnel junctions are configured so that when a bias is applied to the tunnel junctions, signals undergo a phase shift as they traverse the tunnel junctions between ring segments, thereby propagating signals to an adjacent port in a propagation direction.

In one embodiment the plurality of superconducting tunnel junctions are provided in at least one of series and parallel between adjacent ring segments.

In one embodiment the phase shift is a sum of phase shifts introduced by each of the plurality of tunnel junctions.

In one embodiment the plurality of tunnel junctions includes a sufficient number of tunnel junctions so that the response of each tunnel junction is substantially linear over at least one of: a defined signal frequency range; and, a defined signal power range.

In one embodiment each plurality of tunnel junctions includes: at least two tunnel junctions; at least ten tunnel junctions; at least fifty tunnel junctions; at least one hundred tunnel junctions; and, several hundred tunnel junctions.

In one broad form an aspect of the present invention seeks to provide a microwave circulator including an integrated circuit and having: a number of ports; a respective ring segment coupled to each port to allow microwave frequency signals to be transferred between the port and the respective ring segment; and, a plurality of superconducting tunnel junctions interconnecting each pair of adjacent ring segments to form a circulator ring, wherein the tunnel junctions are configured so that when a bias is applied to the tunnel junctions, signals undergo a phase shift as they traverse the tunnel junctions between ring segments, thereby propagating signals to an adjacent port in a propagation direction.

In one embodiment the plurality of superconducting tunnel junctions are provided in at least one of series and parallel between adjacent ring segments.

In one embodiment the phase shift is a sum of phase shifts introduced by each of the plurality of tunnel junctions.

In one embodiment the plurality of tunnel junctions includes a sufficient number of tunnel junctions so that the response of each tunnel junction is substantially linear over at least one of: a defined signal frequency range; and, a defined signal power range.

In one embodiment each plurality of tunnel junctions includes: at least two tunnel junctions; at least ten tunnel junctions; at least fifty tunnel junctions; at least one hundred tunnel junctions; and, several hundred tunnel junctions.

In one embodiment the propagation direction is dependent on at least one of a magnitude and polarity of the bias.

In one embodiment the bias includes: a central bias applied to all of the tunnel junctions; and, a segment bias applied to tunnel junctions each ring segment.

In one embodiment the bias includes at least one of a magnetic or electric field.

In one embodiment each port is coupled to a respective ring segment at least one of: capacitively; inductively; and, using a superconducting tunnel junction.

In one embodiment the tunnel junctions provide at least one of: a specific inductance; and, a specific capacitance.

In one embodiment the tunnel junctions are at least one of: Josephson junctions; and, quantum phase slip junctions.

In one embodiment: the tunnel junctions are Josephson junctions; the ports and ring segments are capacitively coupled; the tunnel junctions introduce a specific capacitance between ring segments; and, the bias includes a magnetic field bias.

In one embodiment the tunnel junctions are Josephson junctions including superconducting electrodes separated by a tunnelling barrier, and wherein the junction has a cross sectional area of at least one of: at least 20 $nm^2$; less than 500 $nm^2$; less than 150 $nm^2$; and, about 100 $nm^2$.

In one embodiment the tunnel junctions are Josephson junctions and the current density is at least one of: between 20 and 200 $A/m^2$; and, between $0.2\times10^8$ and $4\times10^8$ $A/m^2$.

In one embodiment the integrated circuit includes: a substrate; a first superconducting film provided on the substrate that is to form a lower electrode of each Josephson junction; an insulating layer provided on at least part of the first conductive film that forms the Josephson tunnelling barrier of the Josephson junctions; and, a second superconducting film spanning the insulating layer on adjacent lower electrodes to form counter electrodes of each Josephson junction.

In one embodiment at least one of: the superconducting films are made of at least one of: niobium; and, aluminium; and, the insulating layer is made of aluminium oxide.

In one embodiment the bias includes: a central bias generated by applying a magnetic field to the ring; and, a segment bias generated by applying a bias voltage to each ring segment.

In one embodiment: the tunnel junctions are quantum phase slip junctions; the ports and ring segments are inductively coupled; the tunnel junctions introduce a specific inductance between ring segments; and, the bias includes a charge bias.

In one embodiment the tunnel junctions are quantum phase slip junctions including nanoscale width conductors extending radially to a central island.

In one embodiment the nanoscale width conductors include a section having a width of at least one of: greater than 10 nm; less than 100 nm; and, about 40 nm.

In one embodiment the bias includes: a central charge bias generated by applying a bias voltage to the central island; and, a segment bias generated by applying a bias magnetic field to each ring segment.

In one embodiment the tunnel junctions are quantum phase slip junctions including Josephson junctions in series with one or more inductors.

In one embodiment the circulator includes at least three ports and three ring segments.

In one embodiment the microwave circulator includes: multiple respective ring segments coupled to each port to allow microwave frequency signals to be transferred between the port and the respective ring segments, the multiple ring segments being arranged to define multiple parallel circulator rings; and, at least one superconducting tunnel junction interconnecting each pair of adjacent ring segments in a circulator ring, wherein the tunnel junctions are configured so that when a bias is applied to the tunnel junctions, signals undergo a phase shift as they traverse the tunnel junctions between ring segments, thereby propagating signals to an adjacent port in a propagation direction, and wherein the circulator rings propagate signals having a different frequency range.

In one embodiment the circulator includes: at least two circulator rings; at least three circulator rings; at least five circulator rings; and, at least ten circulator rings.

In one embodiment each port is coupled to at least one of the multiple respective ring segments at least one of: capacitively; inductively; and, using a superconducting tunnel junction.

In one embodiment each port is coupled to a first ring segment, and wherein the other ring segments are coupled to the first ring segment at least one of: capacitively; inductively; and, using a superconducting tunnel junction.

It will be appreciated that the broad forms of the invention and their respective features can be used in conjunction and/or independently, and reference to separate broad forms is not intended to be limiting. Furthermore, it will be appreciated that features of the method can be performed using the system or apparatus and that features of the system or apparatus can be implemented using the method.

BRIEF DESCRIPTION OF THE DRAWINGS

An example of the present invention will now be described with reference to the accompanying drawings, in which:—

DETAILED DESCRIPTION OF THE PREFERRED EMBODIMENTS

For the purpose of the following explanation, the term linear microwave circulator is intended to refer to a microwave circulator capable of exhibiting a more linear response than those of the art, whilst the high bandwidth microwave circulator is intended to refer to a microwave circulator capable of operation over a higher bandwidth than those of the art. These terms are used primarily to distinguish between two different arrangements, and are not intended to be limiting, unless otherwise stated. For example, it will be appreciated that the linear microwave circulator will not have a linear response under all circumstances, and this is merely intended to denote a more linear response than other arrangements.

Figure 1:
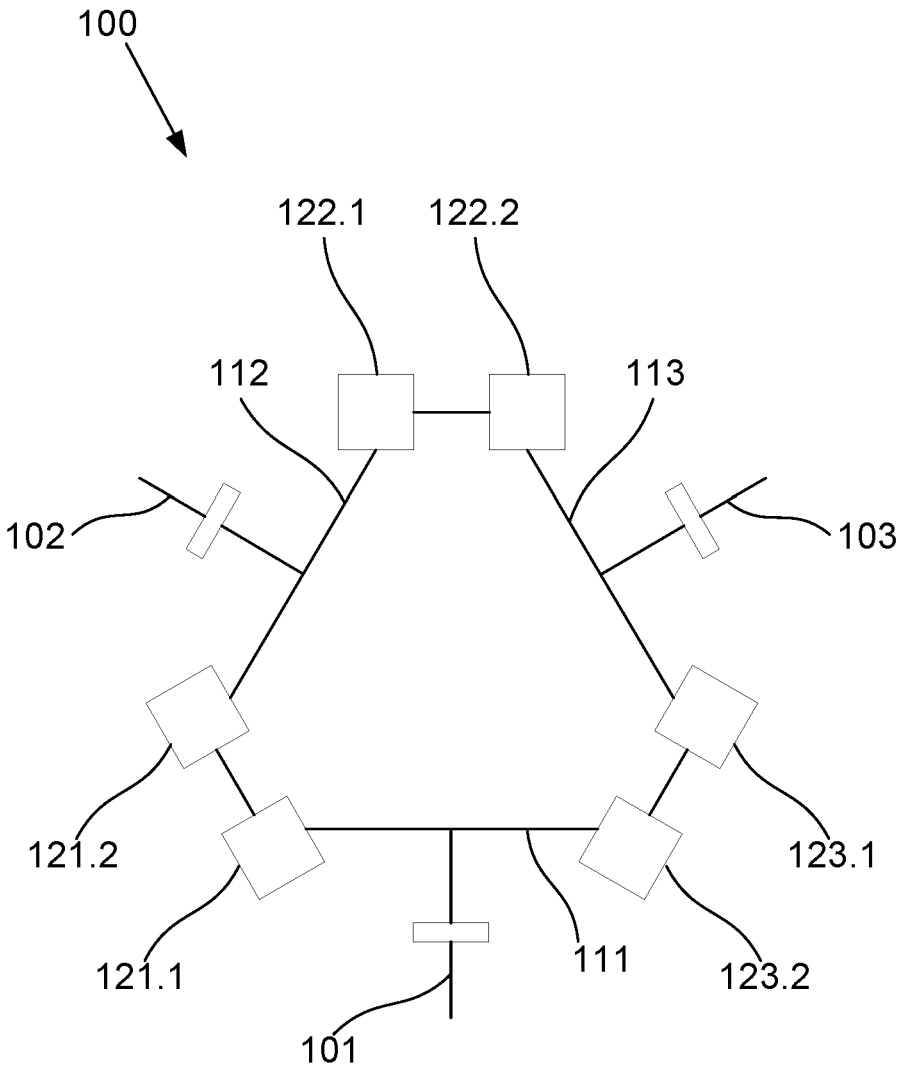
FIG. 1 is a schematic diagram of an example of a linear microwave circulator.

An example of a microwave circulator will now be described with reference to FIG. 1.

In this example, the microwave circulator is formed on an integrated circuit and includes a number of ports 101, 102, 103 with each port 101, 102, 103 being coupled to a respective ring segment 111, 112, 113. The ports 101, 102, 103 are coupled to the ring segments 111, 112, 113 to allow microwave frequency signals to be transferred between the port 101, 102, 103 and the respective ring segment 111, 112, 113. Coupling can be achieved utilising a variety of mechanisms and could include capacitive or inductive coupling. It will be appreciated that the ports 101, 102, 103 can be provided external to the integrated circuit and coupled via on board or off board components to the respective ring segment 111, 112, 113, which is typically formed from conductive tracks on the integrated circuit.

The microwave circulator further includes a plurality of superconducting tunnel junctions 121.1, 121.2, 122.1, 122.2, 123.1, 123.2 interconnecting each pair of adjacent ring segments 111, 112, 113 to form a circulator ring. The tunnel junctions 121.1, 121.2, 122.1, 122.2, 123.1, 123.2 are configured so that when a bias is applied to the tunnel junctions 121.1, 121.2, 122.1, 122.2, 123.1, 123.2, signals transmitted between the ports 101, 102, 103 undergo a phase shift as they traverse the tunnel junctions 121.1, 121.2, 122.1, 122.2, 123.1, 123.2 between the ring segments 111, 112, 113. The phase shift is configured so that signals propagate to an adjacent port 101, 102, 103 in a propagation direction, but do not propagate to an adjacent port 101, 102, 103 in a counter-propagation direction.

Accordingly, the above described arrangement acts as a microwave circulator, allowing a microwave signal to be forwarded to an adjacent port 101, 102, 103 in a propagation direction only.

In contrast to microwave circulators described in "A passive on-chip, superconducting circulator using rings of tunnel junctions" by Clemens Müller, Shengwei Guan, Nicolas Vogt, Jared H. Cole, Thomas M. Stace, 28 Sep. 2017 arXiv:1709.09826, which use a single superconducting tunnel junction between ring segment, the current arrangement uses a plurality of superconducting tunnel junctions 121.1, 121.2, 122.1, 122.2, 123.1, 123.2 interconnecting each pair of adjacent ring segments 111, 112, 113, which results in a more linear response. In particular, the origin of any non-linearity arises due to the scattering response of the superconducting tunnel junctions 121.1, 121.2, 122.1, 122.2, 123.1, 123.2. However, if each of the plurality of junctions 121.1, 121.2, 122.1, 122.2, 123.1, 123.2 is configured to only induce a small phase shift across each junction 121.1, 121.2, 122.1, 122.2, 123.1, 123.2, the response of each individual junction 121.1, 121.2, 122.1, 122.2, 123.1, 123.2 is more linear, resulting in a greater linearity for the microwave circulator in turn making it possible to circulate higher power signals.

Accordingly, this allows a microwave circulator to be constructed utilising on-chip superconducting tunnel junctions, and which has a highly linear response which is not feasible utilising existing arrangements.

A number of further features will now be described.

In one example, the plurality of superconducting tunnel junctions 121.1, 121.2, 122.1, 122.2, 123.1, 123.2 are provided in series or in parallel between adjacent ring segments 111, 112, 113, depending on the tunnel configuration. In practice, the propagating signals pass through each of the tunnel junctions 121.1, 121.2, 122.1, 122.2, 123.1, 123.2 in turn so that the total phase shift as a signal propagates between ports 101, 102, 103 is a sum of the phase shifts introduced by each of the plurality of tunnel junctions 121.1, 121.2, 122.1, 122.2, 123.1, 123.2. Appropriate configuration of the phase shift can be arranged to cause appropriate interference between signals travelling through the circulator ring. For example, when a signal is input via the port 101, the signal is transmitted in both propagation and counter propagation directions. The signals travelling in both directions around the ring interfere when received at the ports 102, 103. Through appropriate configuration of the phase shifts, this can be arranged to ensure constructive interference at port 102 and destructive interference at port 103, thereby ensuring signals received on port 101 are propagated to port 102 only.

Typically the plurality of tunnel junctions 121.1, 121.2, 122.1, 122.2, 123.1, 123.2 include a sufficient number of tunnel junctions 121.1, 121.2, 122.1, 122.2, 123.1, 123.2 so that the response of each of the tunnel junctions 121.1, 121.2, 122.1, 122.2, 123.1, 123.2 is substantially linear over a defined signal frequency range and/or defined signal power range. The number of junctions 121.1, 121.2, 122.1, 122.2, 123.1, 123.2 selected will vary depending upon the particular preferred implementation but typically this will include at least two tunnel junctions, at least ten tunnel junctions, and may include at least fifty tunnel junctions, at least one hundred tunnel junctions and may include several hundred or thousand tunnel junctions, depending on the preferred application for which the circulator is used. In this regard it will be appreciated that fabrication of tunnel junctions 121.1, 121.2, 122.1, 122.2, 123.1, 123.2 on an integrated circuit is relatively straightforward and increasing the number of tunnel junctions 121.1, 121.2, 122.1, 122.2, 123.1, 123.2 allows a highly linear response to be created. The size of the junctions are scaled depending on the number of junctions, so that the total phase shift across all junctions is similar to that in the single junction prior art arrangement, as will be described in more detail below.

Typically the propagation direction is dependent upon the magnitude and/or polarity of the applied bias. The applied bias will typically include a central bias applied to all of the tunnel junctions 121.1, 121.2, 122.1, 122.2, 123.1, 123.2 and may also include a segment bias applied to the tunnel junctions 121.1, 121.2, 122.1, 122.2, 123.1, 123.2 in each ring segment 111, 112, 113. These biases can include magnetic or electric fields and can be applied by applying a voltage or placing the integrated circuit in a magnetic field.

The tunnel junctions 121.1, 121.2, 122.1, 122.2, 123.1, 123.2 are typically either Josephson junctions or quantum phase slip (QPS) junctions. Examples of configurations of Josephson and QPS junctions are shown in FIGS. 2A, 2B, 2C and 2D including both two and three tunnel junction arrangements. These examples use reference numerals similar to those shown in FIG. 1 albeit increased by 100.

Figure 2A:
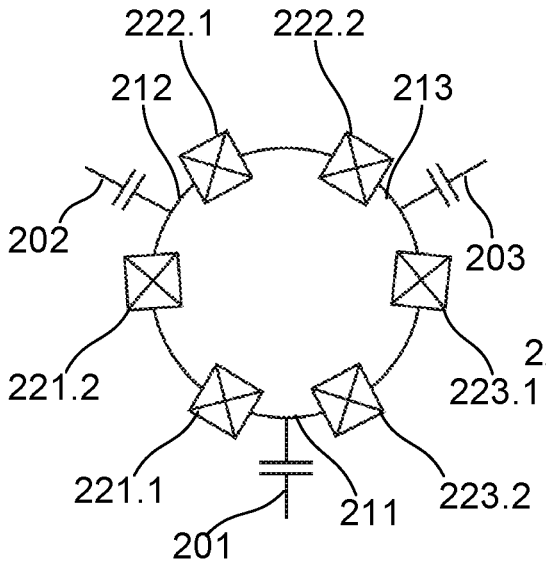
FIGS. 2A and 2B are schematic diagrams of examples of linear microwave circulators implemented using Josephson junctions.

Accordingly, in FIG. 2A three ports 201, 202, 203 are provided which are capacitively coupled to respective ring segments 211, 212, 213. Two Josephson junctions 221.1, 221.2 are provided between the ring segments 211, 212, whilst two Josephson junctions 222.1, 222.2 are provided between the ring segments 212, 213 and finally two junctions 223.1, 223.2 are provided between the ring segments 213, 211.

Figure 2B:
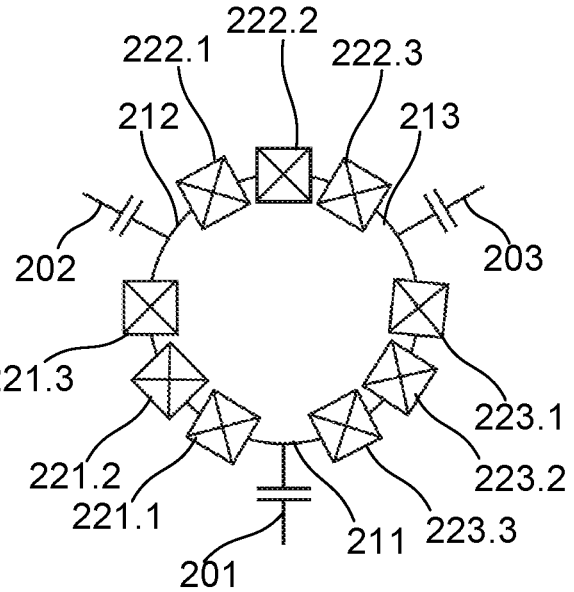

The arrangement of FIG. 2B is similar albeit with an additional Josephson junction 221.3, 222.3, 223.3 between each pair of ring segments 211, 212, 213, and it will be appreciated that these configurations can be scaled further to include additional junctions.

Figure 2C:
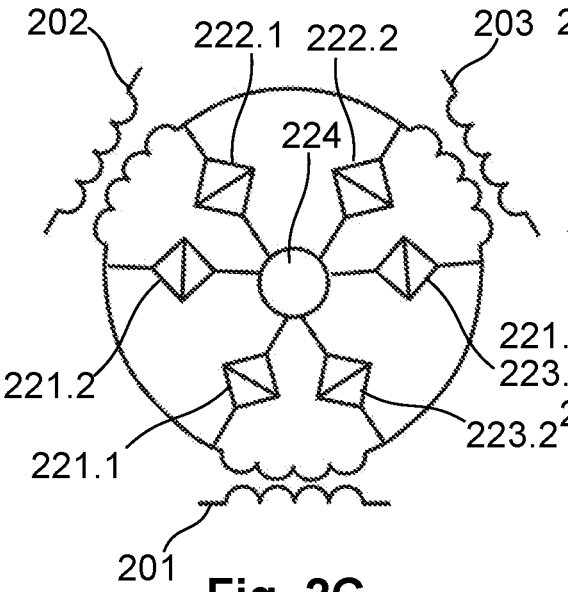
FIGS. 2C and 2D are schematic diagrams of examples of linear microwave circulators implemented using quantum phase shift junctions.
Figure 2D:
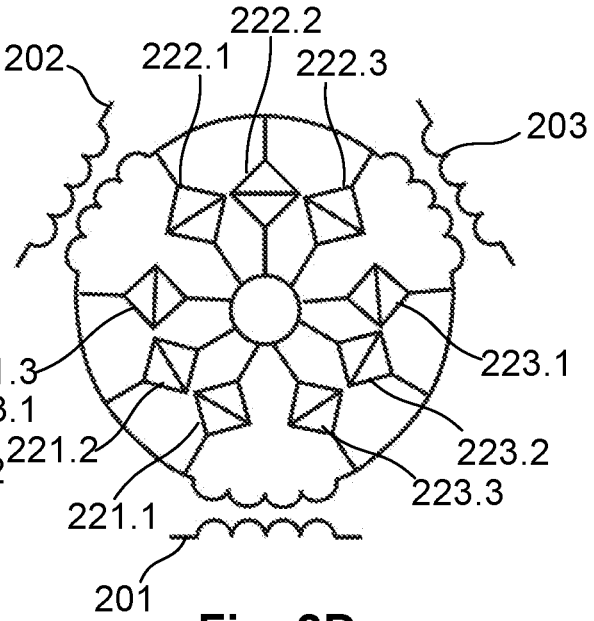

The example shown in FIGS. 2C and 2D utilise QPS junctions, which include nano-scale conductors extending radially inwardly to a central island 224, but otherwise use the same reference numerals to denote similar features.

Figure 3A:
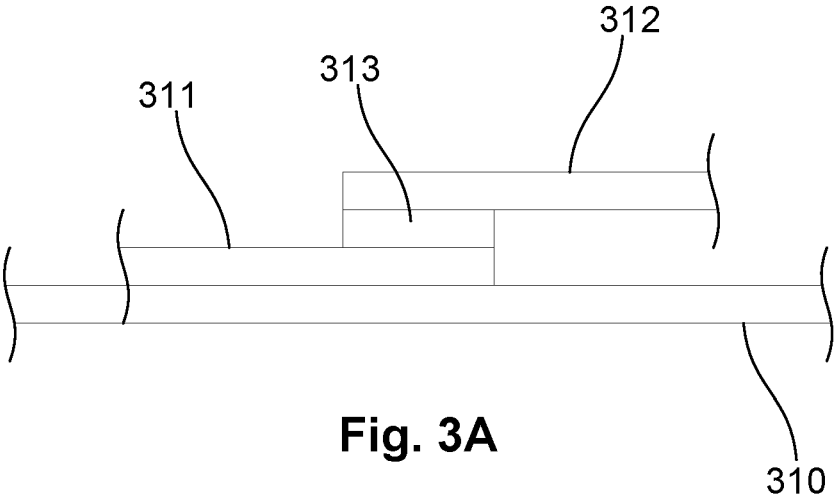
FIGS. 3A and 3B are schematic side and plan views of a Josephson junction.
Figure 3B:
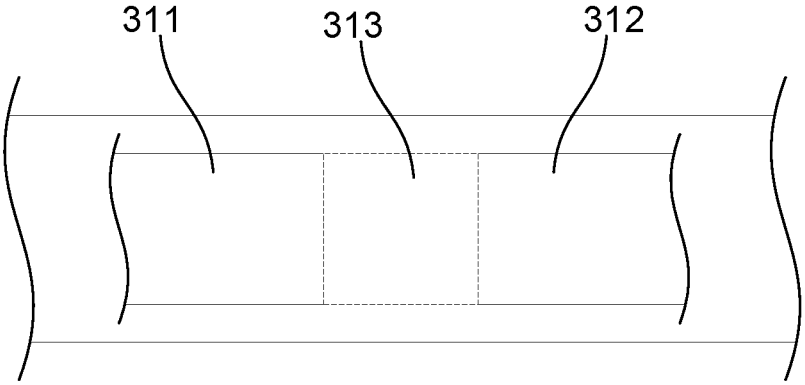

When the tunnel junctions are Josephson junctions, the ports 201, 202, 203 and rings segments 211, 212, 213 are capacitively coupled, either using a capacitor or a Josephson junction, with the Josephson junctions 221.1, 221.2, 222.1, 222.2, 223.1, 223.2 introducing a specific capacitance between the ring segments 211, 212, 213. In this instance, the bias and in particular the central bias includes a magnetic field, which is obtained by applying the magnetic field to the ring. In one example, this can be achieved by applying a magnetic field to the entire integrated circuit on which the device is constructed. In contrast to prior art arrangements however, the size of field is more limited, meaning this doesn't interfere with other equipment. If required, a segment bias can be generated by applying a bias voltage to each ring segment.

Where the tunnel junctions are Josephson junctions, each junction includes superconducting electrodes separated by a tunnelling barrier. An example of the physical construction of a single Josephson junction is shown in FIGS. 3A and 3B.

In this example the integrated circuit includes an integrated circuit substrate 310 and a first superconducting film 311 provided on the substrate 310, which forms a lower electrode of the junction. An insulating layer 313 is provided on part of the first conductive film 311 to form the Josephson tunnelling barrier, with a second superconducting film 312 then provided on top of the insulating layer to form an upper electrode. In general the superconducting films are made of niobium and/or aluminium, whilst the insulating layer is made of aluminium oxide. It will be appreciated however that other suitable arrangements can be used.

Figure 3C:
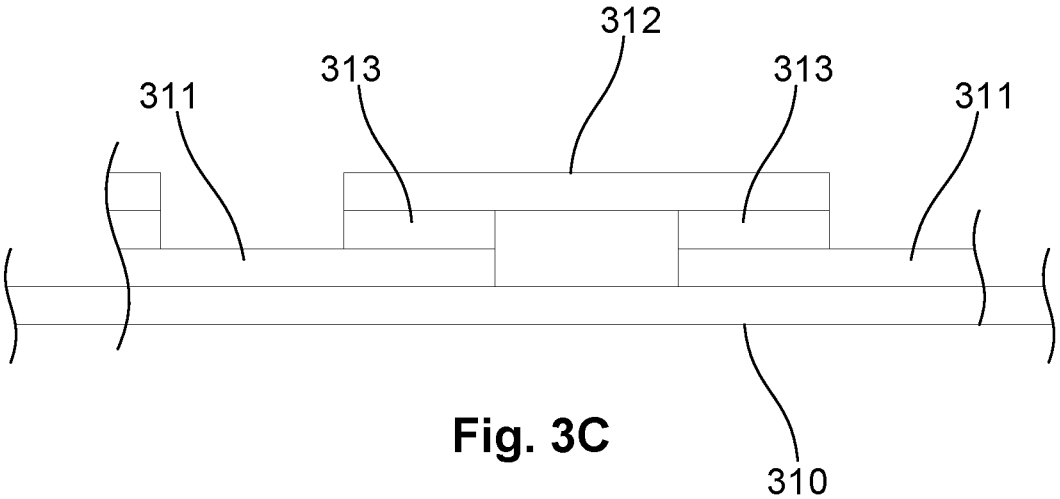
FIG. 3C is a schematic side view showing a number of interconnected Josephson junctions.

It will be appreciated that multiple junctions can be arranged in series by having the second superconducting film spanning the insulation layer on adjacent lower electrodes to form counter electrodes for each Josephson junction as shown in FIG. 3C. Further construction details and fabrication techniques for such arrangements are known in the art, for example from the manufacture of Josephson voltage standard devices, and this will not therefore be described in any further detail.

The properties of the Josephson junction will vary depending on the physical configuration of the junctions, including the types of materials used, and the thickness and cross sectional area of the insulating layer. In one example, the Josephson junctions typically have a cross-sectional area, shown by dotted lines in FIG. 3B, that is selected in order to achieve a desired phase change for a given applied signal. In practice, this is scaled compared to a single junction arrangement in order to obtain a similar overall phase change, so that for a single junction configuration having an area A, for a sequence of N junctions, the junction area of each of the N junctions, would be N×A. Typical cross section areas include at least 20 $nm^2$, less than 500 $nm^2$, less than 150 $\mu m^2$ and about 100 $nm^2$, whilst the junctions typically have current density of between 20 and 200 amps per $m^2$ or between $0.2\times10^8$ and $4\times10^8$ amps per $m^2$, although it will be appreciated that the exact size and current density will depend on the materials used and the particular characteristics sought for the arrangement.

As previously mentioned, alternatively the junctions are QPS junctions, in which case the ports 201, 202, 203 and ring segments 211, 212, 213 are inductively coupled, either using an inductor or a QPS junction, with the QPS junctions 221.1, 221.2, 222.1, 222.2, 223.1, 223.2 introducing a specific inductance between ring segments 211, 212, 213. The bias in this case, and in particular the central bias, is a bias charge, which is obtained by applying an electric field to the central island 224, whilst a segment bias can be generated by applying a magnetic field to each ring segment.

The QPS junctions typically include nanoscale width conductors extending radially to the central island 224, with the nanoscale width conductors optionally including a width of greater than 10 nm, less than 100 nm and about 40 nm.

In another example, the tunnel junctions are quantum phase slip junctions including Josephson junctions in series with one or more inductors.

In the above examples the circulators include three ports and three ring segments although this is not intended to be limiting, and other arrangements, such as four port variations, are contemplated.

Figure 4:
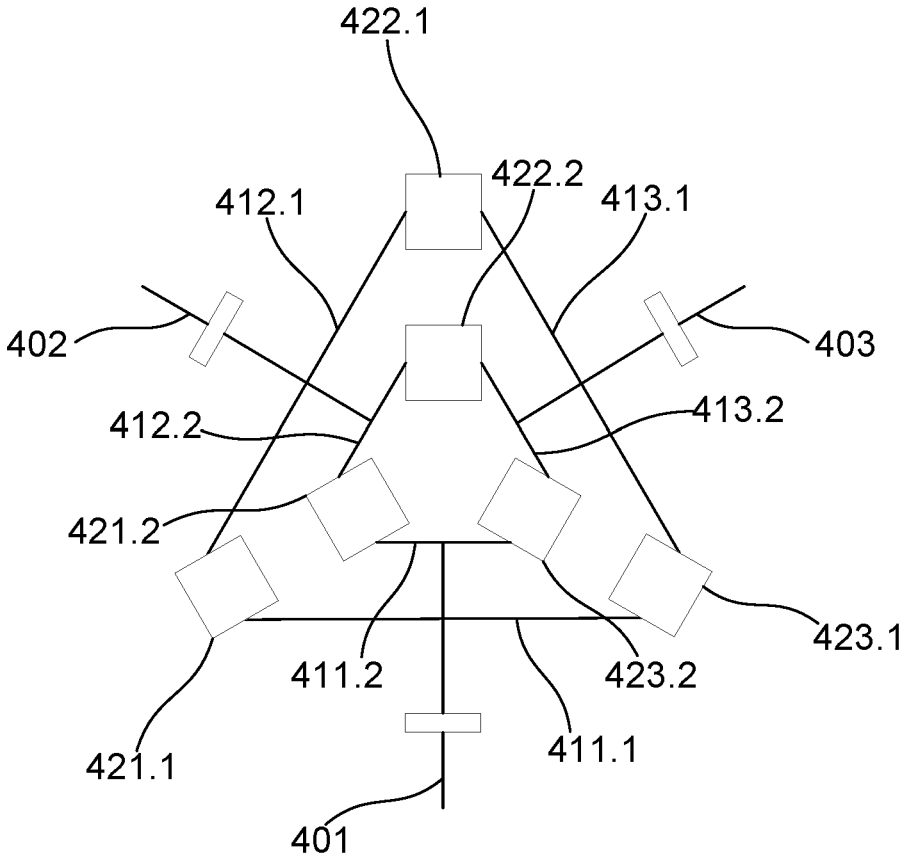
FIG. 4 is a schematic diagram of an example of a high bandwidth microwave circulator.

An example of a high bandwidth microwave circulator will now be described with reference to FIG. 4.

In this example, the microwave circulator is formed on an integrated circuit and includes a number of ports 401, 402, 403, with multiple ring segments 411.1, 411.2, 412.1, 412.2, 413.1, 413.2 being coupled to each port 401, 402, 403 to allow microwave frequency signals to be transferred between the port 401, 402, 403 and the respective ring segments 411.1, 411.2, 412.1, 412.2, 413.1, 413.2. The multiple ring segments 411.1, 411.2, 412.1, 412.2, 413.1, 413.2 are arranged to define multiple parallel circulator rings. In this example two rings are provided, including a first ring formed from the ring segments 411.1, 412.1, 413.1 and a second ring formed form the ring segments 411.2, 412.2, 413.2, although it will be appreciated that this is not intended to be limiting and in practice a greater number of rings could be provided.

At least one superconducting tunnel junction 421.1, 421.2, 422.1, 422.2, 423.1, 423.2 is provided interconnecting each pair of adjacent ring segments 411.1, 411.2, 412.1, 412.2, 413.1, 413.2 in each circulator ring. Thus, the superconducting tunnel junction 421.1 interconnects ring segments 411.1, 412.1, the superconducting tunnel junction 421.2 interconnects ring segments 411.2, 412.2, and so on. The tunnel junctions 421.1, 421.2, 422.1, 422.2, 423.1, 423.2 are configured so that when a bias is applied to the tunnel junctions 421.1, 421.2, 422.1, 422.2, 423.1, 423.2, signals undergo a phase shift as they traverse the tunnel junctions 421.1, 421.2, 422.1, 422.2, 423.1, 423.2 between the ring segments 411.1, 411.2, 412.1, 412.2, 413.1, 413.2, thereby propagating signals to an adjacent port 401, 402, 403 in a propagation direction.

The circulator rings propagate signals having different frequency ranges so that the apparatus includes a high bandwidth allowing for a greater frequency range of signals to be transmitted. In one example, each circulator ring has a different configuration, and in particular includes different configurations of tunnel junctions 421.1, 421.2, 422.1, 422.2, 423.1, 423.2 and/or applied biases, so as to propagate signals having a different frequency range. This effectively tunes each circulator ring so that it preferentially propagates signals in different frequency bands. Additionally and/or alternatively, the increased bandwidth response can be achieved by virtue of coupling between the rings, with this typically being achieved using a combination of these approaches in practice.

Irrespective of how this can be achieved, the above described arrangement acts in a manner similar to the previous example, enabling it to function as a microwave circulator so that microwave signals are forwarded to an adjacent port 401, 402, 403 in a propagation direction only.

In contrast to microwave circulators described in "A passive on-chip, superconducting circulator using rings of tunnel junctions" by Clemens Müller, Shengwei Guan, Nicolas Vogt, Jared H. Cole, Thomas M. Stace, 28 Sep. 2017 arXiv:1709.09826, which use a single ring, the current arrangement uses a number of circulator rings arranged in parallel, which through appropriate configuration, results in a higher bandwidth response. In particular, in interference based devices of this form, the bandwidth is determined by a central frequency, given by two closely spaced eigenfrequencies of the device, and the coupling strength to these eigenmodes. Extending the single ring structure to a multiple ring structure adds more closely spaced eigenmodes at or around the same centre frequency, as it effectively opens more pathways for excitations to propagate through the device. With appropriately designed parameters, this leads to much higher bandwidth than the original design.

At the same time, this will also decrease the device sensitivity to perturbations in external bias parameters, like central and ring segment biases. In this regard, variations in central bias mainly shift the central frequency, but as long as the variations are small compared to the bandwidth, this will not negatively influence performance. Variations in segment bias can be understood as pinching of some of the resonant pathways in the device, strongly limiting the performance in the single ring case, whilst a multiple parallel ring structure will be far more robust to this kind of perturbation.

Accordingly, this allows a microwave circulator to be constructed utilising on-chip superconducting tunnel junctions which has a high bandwidth response which is not feasible utilising existing arrangements.

A number of further features will now be described.

It will be appreciated that the number of circulator rings will vary depending upon the preferred implementation and in particular the defined signal frequency range and/or defined signal power range, for which signals are to be transmitted. In one example, the arrangement could include two, three, five, ten or more circulatory rings depending upon the particular application, and the bandwidth required.

Typically the propagation direction is dependent upon the magnitude and/or polarity of the applied bias. The applied bias will typically include a central bias applied to all of the tunnel junctions 421.1, 421.2, 422.1, 422.2, 423.1, 423.2 and may also include a segment bias applied to the tunnel junctions 421.1, 421.2, 422.1, 422.2, 423.1, 423.2 in each ring segment 411.1, 411.2, 412.1, 412.2, 413.1, 413.2. These biases can include magnetic or electric fields and can be applied by applying a voltage or placing the integrated circuit in a magnetic field.

Each port 401, 402, 403 is typically coupled to a respective ring segment either capacitively or inductively and this could be achieved utilising a superconducting tunnel junction, or a suitable capacitor or inductor. The port 401, 402, 403 could be coupled directly to each of the multiple ring segments, 411.1, 411.2, 412.1, 412.2, 413.1, 413.2, or may be coupled to one of the ring segments 411.1, 412.1, 413.1, which are then in turn coupled capacitively or inductively to the other ring segments 411.2, 412.2, 413.2.

Figure 5A:
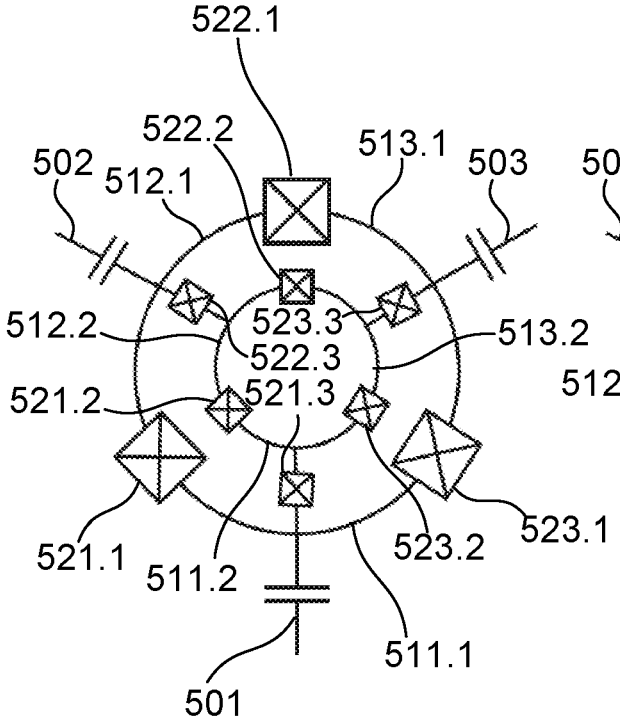
FIGS. 5A and 5B are schematic diagrams of example high bandwidth microwave circulators made with Josephson junctions.
Figure 5B:
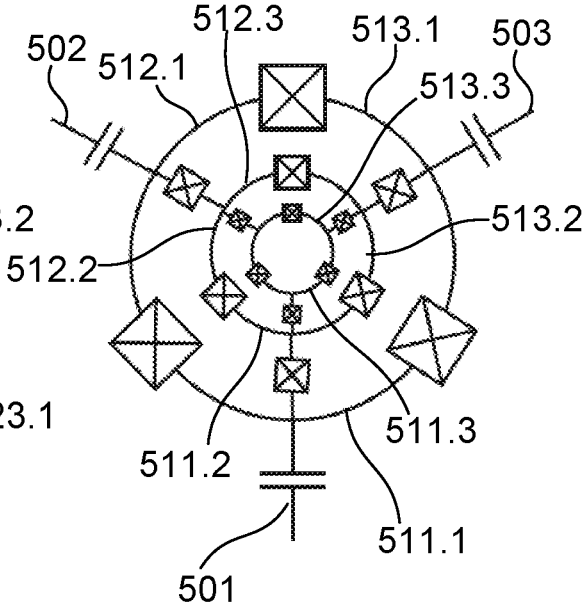
Figure 5C:
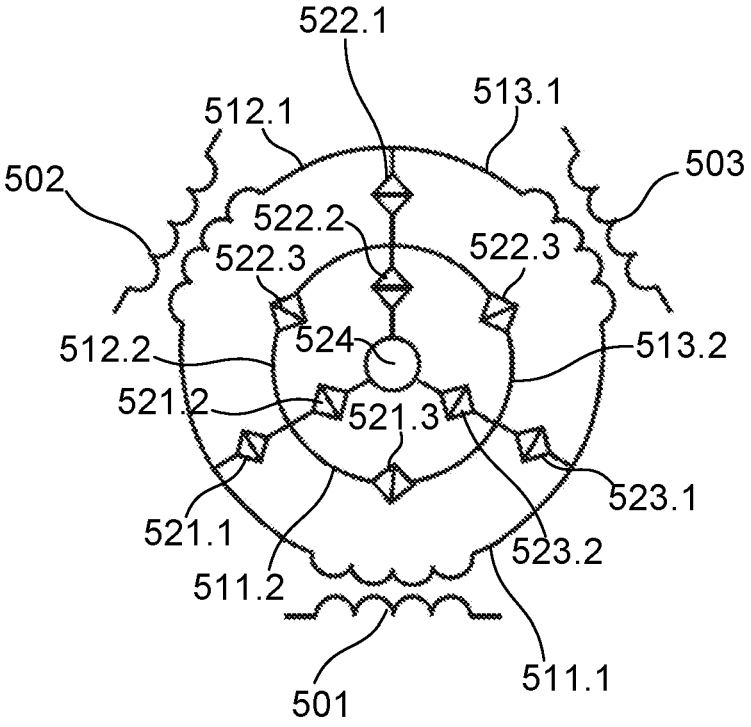
FIG. 5C is a schematic diagram of an example of a high bandwidth microwave circulator made using quantum phase shift junctions.

The tunnel junctions 421.1, 421.2, 422.1, 422.2, 423.1, 423.2 are typically either Josephson junctions or quantum phase slip (QPS) junctions. Examples of configurations of Josephson and QPS junctions are shown in FIGS. 5A and 5B, and FIG. 5C respectively. These examples use reference numerals similar to those shown in FIG. 4, albeit increased by 100.

In the example of FIG. 5A, three ports 501, 502, 503 are coupled to respective ring segments 511.1, 511.2, 512.1, 512.2, 513.1, 513.2 in particular by coupling to an outer ring segment 511.1, 512.1, 513.1, and then interconnecting the ring segments using respective tunnel junctions 521.3, 522.3, 523.3. Individual tunnel junctions 521.1, 521.2, 522.1, 522.2, 523.1, 523.2 are then provided between each pair of ring segments 511.1, 511.2, 512.1, 512.2, 513.1, 513.2. In the example FIG. 5B, a further third ring segment 511.3, 512.3, 513.3 is provided, associated with respective tunnel junctions.

In the example of FIG. 5C a similar arrangement is implemented using QPS junctions, which include nano-scale conductors extending radially inwardly to a central island 524, but otherwise use the same reference numerals to denote similar features.

When the tunnel junctions are Josephson junctions, the ports 501, 502, 503 and ring segments 511.1, 511.2, 512.1, 512.2, 513.1, 513.2 are capacitively coupled, either using a capacitor or a Josephson junction, with the Josephson junctions 521.1, 521.2, 522.1, 522.2, 523.1, 523.2 introducing a specific capacitance between the ring segments 511.1, 511.2, 512.1, 512.2, 513.1, 513.2. In this instance, the bias and in particular the central bias includes a magnetic field, which is obtained by applying the magnetic field to the ring, and in particular to the entire integrated circuit, whilst segment bias is generated by applying a bias voltage to each ring segment.

Where the tunnel junctions are Josephson junctions, each junction includes superconducting electrodes separated by a tunnelling barrier, as described above with respect to FIGS. 3A and 3B. In this example however, the multiple rings and associated tunnel junctions can be created by extending the structure vertically, to provide an effective 3D arrangement, or through the use of concentric pathways on the integrated circuit substrate.

As previously mentioned, the properties of the Josephson junction will vary depending on the physical configuration of the junctions, including the types of materials used, and the thickness and cross sectional area of the insulating layer. Accordingly, the junctions in each ring may include similar or different configurations, so that for example, the Josephson junctions may have different cross-sectional areas in different rings, so that each ring has a different frequency response.

As previously mentioned, alternatively the junctions are QPS junctions in which case the ports 501, 502, 503 and ring segments 511.1, 511.2, 512.1, 512.2, 513.1, 513.2 are inductively coupled, either using an inductor or QPS junction, with the QPS junctions introducing a specific inductance between ring segments. The bias in this case, and in particular the central bias, is a bias charge, which is obtained by applying an electric field to the central island 524, whilst the segment bias is generated by applying a magnetic field to each ring segment.

The QPS junctions typically include nanoscale width conductors extending radially to the central island 524, with the nanoscale width conductors having different configurations in each ring to thereby generate a different frequency response.

Figure 6:
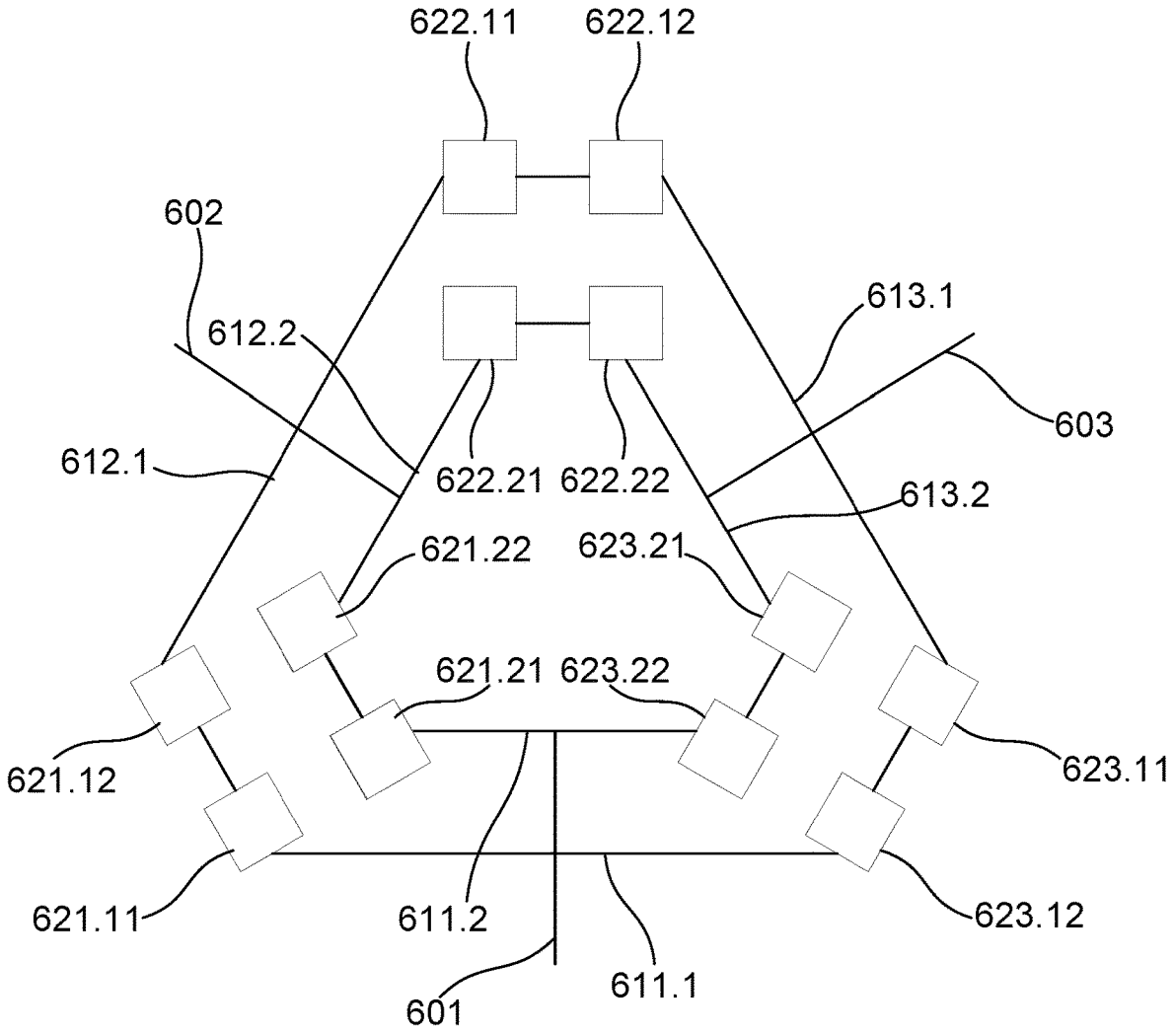
FIG. 6 is a schematic diagram of a high bandwidth linear microwave circulator.

It will further be appreciated that the high bandwidth and linear circulators can be implemented in a single device, an example of which is shown in FIG. 6.

In this example, ports 601, 602, 603 are coupled to respective ring segments 611.1, 611.2, 612.1, 612.2, 613.1, 613.2. Each ring segment is coupled to an adjacent ring segment via multiple superconducting tunnel junctions 621.11, 621.12, 621.21, 621.22, 622.11, 622.12, 622.21, 622.22, 623.11, 623.12, 623.21, 623.22, with two being shown in this example. This provides a high bandwidth circulator with a highly linear response.

Further specific features of the implementation of the arrangements will now be described with reference to FIGS. 7A to 7C.

Figures 7A, 7B, 7C:
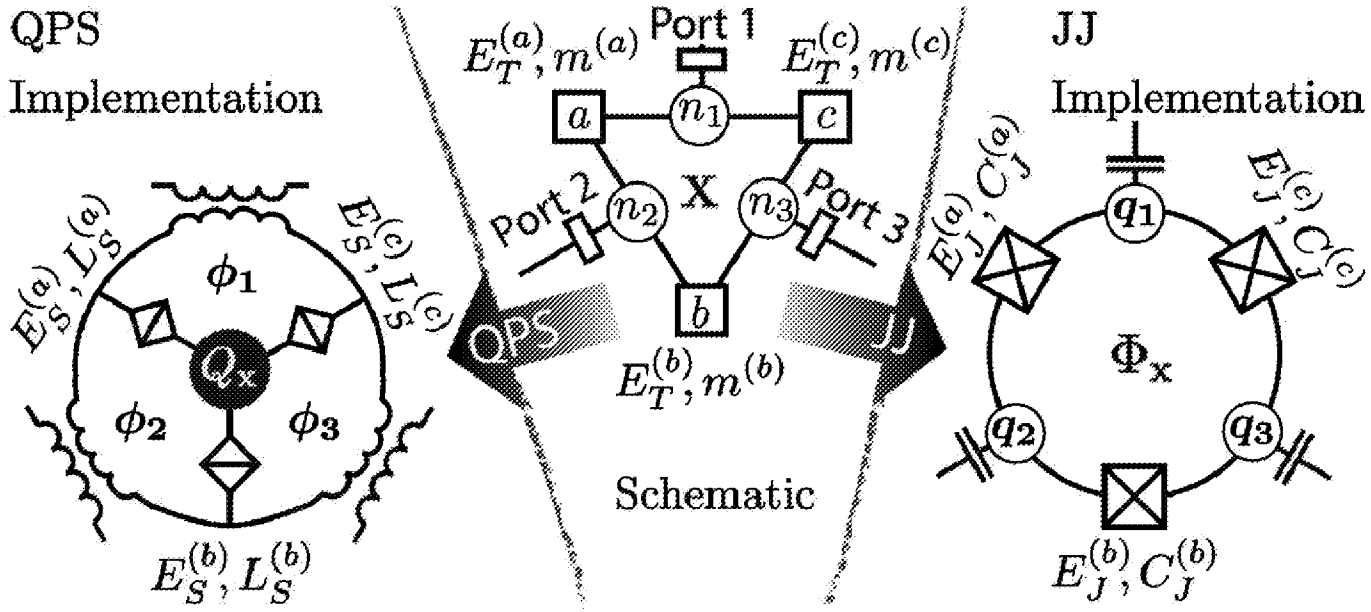
FIG. 7A is a schematic diagram of a microwave circulator.
FIGS. 7B and 7C are schematic diagrams of microwave circulators made using quantum phase shift and Josephson junctions.

As shown in FIG. 7A, the current arrangements provide an integrated microwave circulator realised as three nodes $n_1$, $n_2$, $n_3$ separated by tunnel junctions a, b, c, in a ring geometry. Each node $n_1$, $n_2$, $n_3$ is coupled to outside ports Port 1, Port 2, Port 3 through which microwave signals are routed. The ring extends around a central bias X, which provides the origin of phases required for circulator operation. Specific implementations in the form of a Josephson junction and QPS ring are shown in FIGS. 7C and 7B, respectively.

In the arrangement of FIGS. 7A to 7C, the three ports are connected via coupling elements to the numbered nodes of the ring to the coordinate $n_j$ associated to node j. A central bias X in the middle of the ring, is conjugate to the node $n_j$. Nodes of the ring are mutually coupled by tunnelling elements with tunnelling energy $E_T^{(k)}$, and with kinetic energy/'mass' term $m_T^{(k)}$.

In the QPS implementation of FIG. 7B, the scheme uses flux tunnelling and capacitive bias. Here $n_j \rightarrow \varphi_j/\Phi_0$ represent fluxes in each ring segment which are coupled inductively to the external lines $E_T^{(k)} \rightarrow E_S^{(k)}$, which is the phase slip energy describing tunnelling of fluxes, $m_T^{(k)} = L_S^{(a)}$ is the QPS inductance, and $X \rightarrow Q_x/(2e)$ is the linked charge induced by a voltage on the central island.

The Josephson junction (JJ) of FIG. 7C relies on charge tunnelling and inductive bias. Then $n_j \rightarrow q_j(2e)$ are charge numbers on superconducting islands, which are coupled capacitively to the external lines, $E_T^{(k)} \rightarrow E_J^{(k)}$ is the Josephson energy, $m_T^{(k)} = C_J^{(k)}$ is the JJ capacitance, and $X \rightarrow \Phi_x/\Phi_0$ is the linked magnetic flux threading the ring from an external magnetic field.

The following explanation will focus on the Josephson junction implementation, but the same arguments and explanations also apply to the QPS case but in the conjugate picture, in which the conjugate pairs capacitance and inductance, and charge and flux are exchanged.

Microscopically, during operation of the ring, charges are tunnelling through the Josephson junctions. Due to the presence of a magnetic field through the ring, their motion leads to phases due to the Aharonov-Bohm effect. The circulator essentially works through interference between two different eigenmodes of the ring structure, which correspond to charges moving in different directions and being subject to different phase changes.

It has previously been in shown in "A passive on-chip, superconducting circulator using rings of tunnel junctions" by Clemens Müller, Shengwei Guan, Nicolas Vogt, Jared H. Cole, Thomas M. Stace, 28 Sep. 2017 arXiv:1709.09826, the contents on which are incorporated herein by cross reference, that that the ring can be tuned such that for a signal incident from one port, these two modes interfere destructively at one of the other ports and constructively at the third port, thus only exiting at the third port.

For the QPS ring, the situation is equivalent, but here the moving microscopic entities are quanta of the magnetic field (flux quanta) and the phases are due to the Aharonov-Casher effect (which is the equivalent to the Aharonov-Bohm effect when sitting in a coordinate system where the charge is still and the flux is moving).

Figure 8:
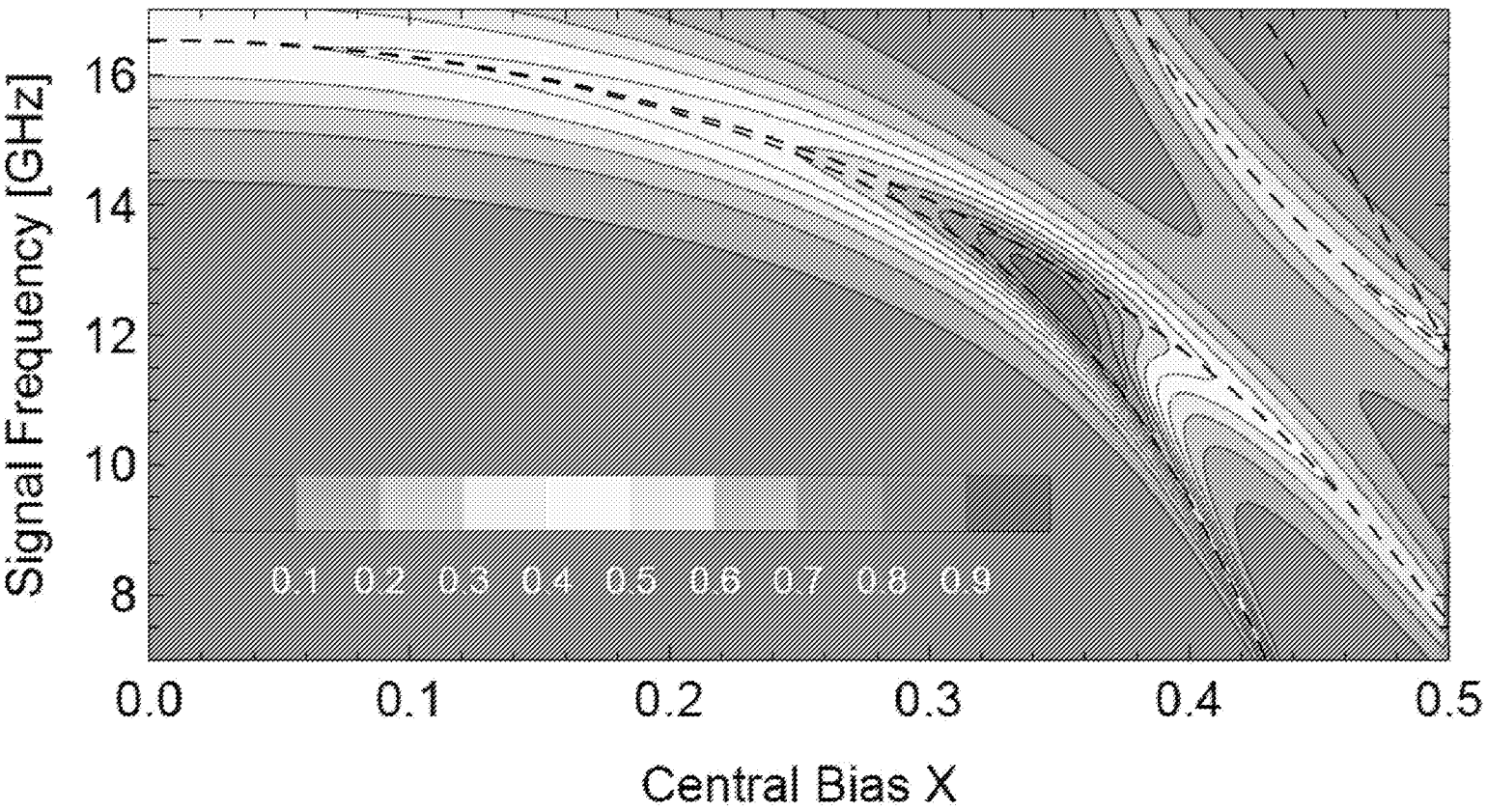
FIG. 8 is a schematic diagram showing a circulator performance for a three junction linear microwave circulator as a function of central bias and signal frequency; and, FIG. 9 is a graph showing scattering matrix elements as a function of power demonstrating saturation of the circulation and onset of reflection of the input signal.

FIG. 8 illustrates the bias and frequency conditions under which the circulation works, and in particular shows the circulator performance for a three junction design of FIGS. 7A to 7C as a function of central bias and signal frequency. The scale indicates the power scattering parameter S31 for clockwise circulation from Port 1 into Port 3, with a value of 1 being ideal circulation. Dashed lines indicate the position of levels of the ring structure, illustrating the working principle of the ring as a circulator.

Thus, for a certain central bias X, there is a range of frequencies (indicated by the contours) where circulation in a clockwise direction happens with near unit efficiency, i.e. all the power incident at an input port is transferred to the next port in a clockwise direction. Perfect circulation occurs for signal frequencies that are located in between the energies of two levels of the ring structure, indicated by the dashed black lines in FIG. 8.

A certain amount of central bias is required before circulation can occur, such that the interference between the two levels is of the right kind. For larger central bias, $0.5<X<1$, the circulation direction is reversed, with the picture otherwise the same as FIG. 8.

Figure 9:
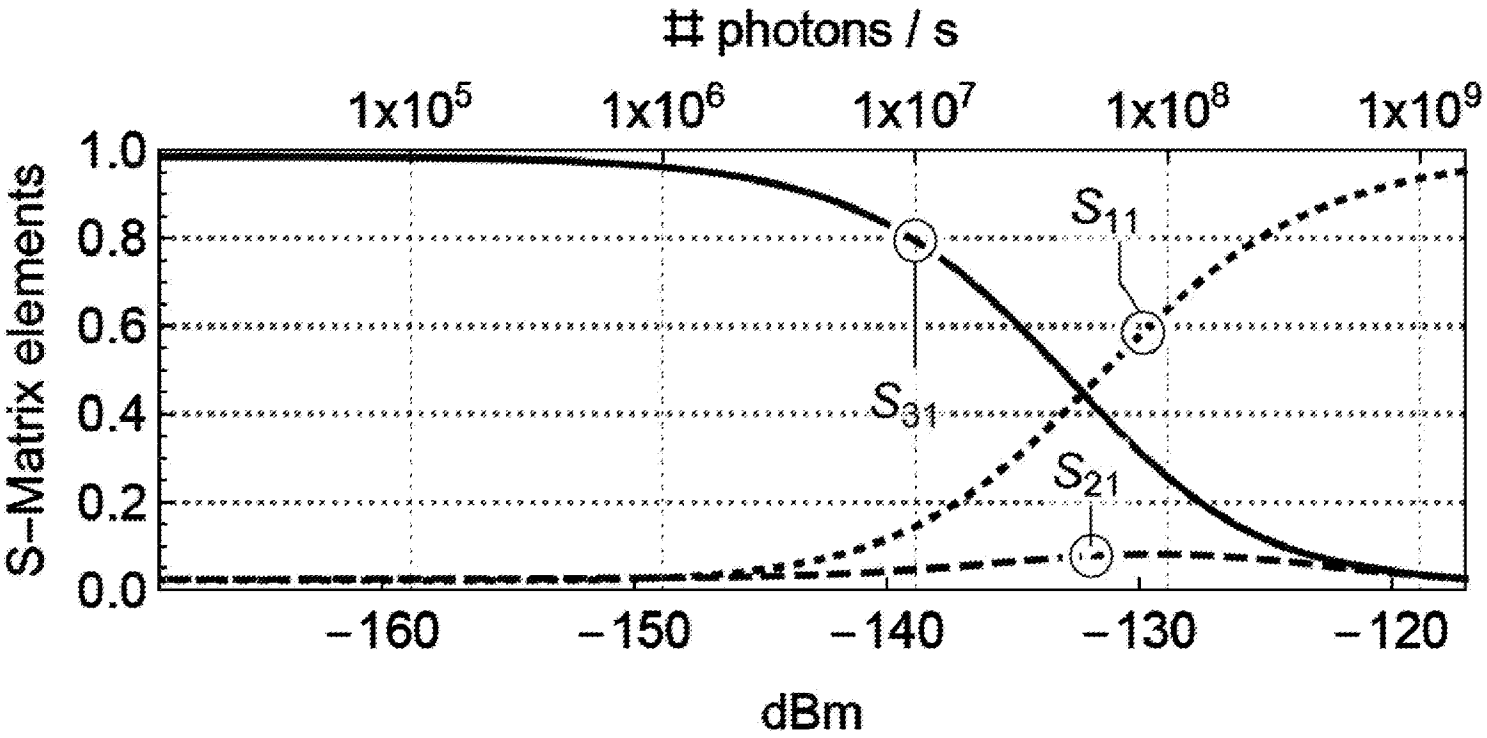

Increasing the signal power, circulation efficiency is affected adversely, as illustrated in FIG. 9, which shows scattering matrix elements as function of power, demonstrating saturation of the circulation and onset of reflection of the input signal. Thus, circulation in a clockwise direction (solid line) is reduced when increasing input power and reflection of the signal from the ring (dotted line) increases.

Improving Linearity

To increase linearity in the response, it is necessary to understand the origin of the substantial nonlinearity in the three junction designs of FIGS. 7A to 7C. This is relatively straightforward to see when comparing to the classical circulators, where coupling to two harmonic modes and the interaction between them enables circulation. Each of these modes can in principle be populated by an infinite number of photons, without changing the underlying physics, for infinite power transmission (in practice even very small non-linearities will arise at some point).

In the arrangement of FIGS. 7A to 7C, circulation is based on coupling to two single levels, i.e. the extreme nonlinear limit of the above classical case. These can never be populated by more than a single photon at the same time, resulting in the strongly nonlinear behaviour seen in FIG. 9. The non-linearity in the circuit is in fact introduced through the use of tunnel junctions which are described by the Hamiltonian term:

$$\sim E_j \cos \phi \tag{1}$$

where $E_j=\Phi_0 I_c/2\pi$ is the Josephson energy (proportional to the junction's critical current and therefore the area of the junction) and $\phi$ is the phase drop across the junction.

In the limit of small phase drop, this can be approximated by a linear expression:

$$\sim E_j \cos \phi \approx E_j(1-\phi^2+0(\phi^4)) \tag{2}$$

In operation, the phase drop across the junctions is not necessarily small. However, by replacing the single junction by multiple junctions with scaled parameters, this can emulate the linear behaviour of the single junctions in the linear regime. If N junctions are provided in series and there is a total phase drop of $\phi$ across all of them, then since the junctions are all equivalent, the total phase drop is distributed equally and get:

$$\Sigma_N E_{j,N} \cos \phi_N = \Sigma_N E_{j,N} \cos \phi/N E_{j,N}(\phi/N)^2 = N E_{j,N}/N\phi^2 \tag{3}$$

which is equivalent to (2) for a choice of $E_{j,N}=NE_j$. In other words when the Josephson energy of the multiple junction is N times larger than the Josephson energy in the single junction case.

Conversely, this means that the critical current and therefore the area of each of the multiple junctions has to be larger by a factor N compared to the single junction case, to preserve the same physical characteristics of the device.

For the QPS junctions, the QPS energy is proportional to the length of the wire, which will have to be scaled accordingly.

Increasing Bandwidth

The bandwidth is one of the main performance metrics for a circulator and is indicative of the range of frequency over which the circulator performs as intended. Primarily the bandwidth in the three port device is limited by the strength of the coupling between the outside ports and the (near) resonant eigenmodes of the ring. Only when the signal can couple simultaneously to two levels of the ring can circulation work. Increasing the bandwidth through an increase in this coupling strength quickly meets physical limits from the strength of the required capacitances.

The current arrangement effectively couples the same input port simultaneously to multiple circulators.

The circulators can be configured so that each individual ring has slightly different parameters, such that the frequency ranges for which they circulate are different but closely spaced and overlapping. The increase in bandwidth here is from effectively using multiple circulators with each of them coupled individually to the ports.

As an alternative approach, multiple equivalent rings can be provided that are coupled to each other either through capacitors or Josephson junctions. In this case the combined structure will have more than two-levels that contribute to the circulation. In the limit of zero coupling between the rings, the levels shown in FIG. 8 will simply be N-fold degenerate (N being the number of rings). Introducing a coupling between the rings will lift that degeneracy and spread the levels out without changing their nature much (assuming relatively weak coupling). The larger the number of levels available, then the larger the spread in energy, which will lead to an increase in bandwidth of the circulator.

In reality, with unavoidable spread in fabrication parameters and cross-coupling due to spacing, a mixture of these two mechanisms will typically arise for the arrangements shown in FIGS. 5A to 5C.

Throughout this specification and claims which follow, unless the context requires otherwise, the word "comprise", and variations such as "comprises" or "comprising", will be understood to imply the inclusion of a stated integer or group of integers or steps but not the exclusion of any other integer or group of integers.

Persons skilled in the art will appreciate that numerous variations and modifications will become apparent. All such variations and modifications which become apparent to persons skilled in the art, should be considered to fall within the spirit and scope that the invention broadly appearing before described.

The invention claimed is:

1. A microwave circulator including an integrated circuit having:

a) a number of ports;

b) multiple respective ring segments coupled to each port to allow microwave frequency signals to be transferred between the respective port and the respective ring segments, the multiple ring segments being arranged to define multiple parallel circulator rings; and, c) at least one superconducting tunnel junction interconnecting each pair of adjacent ring segments in a circulator ring, wherein the tunnel junctions are configured so that when a bias is applied to the tunnel junctions, signals undergo a phase shift as they traverse the tunnel junctions between ring segments, thereby propagating signals to an adjacent port in a propagation direction, and wherein the circulator rings propagate signals having different frequency ranges.

2. A microwave circulator according to claim 1, wherein the circulator includes:

a) at least two circulator rings;

b) at least three circulator rings;

c) at least five circulator rings; or, d) at least ten circulator rings.

3. A microwave circulator according to claim 1, wherein the propagation direction is dependent on at least one of a magnitude and polarity of the bias.

4. A microwave circulator according to claim 1, wherein the bias includes:

a) a central bias applied to all of the tunnel junctions; and, b) a segment bias applied to each ring segment.

5. A microwave circulator according to claim 1, wherein the bias includes at least one of a magnetic or electric field.

6. A microwave circulator according to claim 1, wherein each port is coupled to at least one of the multiple respective ring segments at least one of:

a) capacitively;

b) inductively; and, c) using a superconducting tunnel junction.

7. A microwave circulator according to claim 6, wherein each port is coupled to a first ring segment, and wherein the other ring segments are coupled to the first ring segment at least one of:

a) capacitively;

b) inductively; and, c) using a superconducting tunnel junction.

8. A microwave circulator according claim 1, wherein each circulator ring has at least one of:

a) a different configuration;

b) a different configuration of tunnel junctions;

c) tunnel junctions having different properties; and, d) different biases.

9. A microwave circulator according to claim 1, wherein the circulator rings are at least partially coupled.

10. A microwave circulator according to claim 1, wherein the tunnel junctions provide at least one of:

a) a specific inductance; and, b) a specific capacitance.

11. A microwave circulator according to claim 1, wherein the tunnel junctions are at least one of:

a) Josephson junctions; and, b) quantum phase slip junctions.

12. A microwave circulator according to claim 1, wherein:

a) the tunnel junctions are Josephson junctions;

b) the ports and ring segments are capacitively coupled;

c) the tunnel junctions introduce a specific capacitance between ring segments; and, d) the bias includes a magnetic field bias.

13. A microwave circulator according to claim 1, wherein the tunnel junctions are Josephson junctions including superconducting electrodes separated by a tunnelling barrier, and wherein the junction has a cross sectional area of at least one of:

a) at least 20 $nm^2$;

b) less than 500 $nm^2$;

c) less than 150 $\mu m^2$; and, d) about 100 $nm^2$.

14. A microwave circulator according to claim 1, wherein the tunnel junctions are Josephson junctions and the current density is at least one of:

a) between 20 and 200 $A/m^2$; and, b) between $0.2\times10^8$ and $4\times10^8$ $A/m^2$.

15. A microwave circulator according to claim 13, wherein the integrated circuit includes:

a) a substrate;

b) a first superconducting film provided on the substrate that is to form a lower electrode of each Josephson junction;

c) an insulating layer provided on at least part of a first conductive film that forms the Josephson tunnelling barrier of the Josephson junctions; and, d) a second superconducting film spanning the insulating layer on adjacent lower electrodes to form counter electrodes of each Josephson junction.

16. A microwave circulator according to claim 15, wherein at least one of:

a) the superconducting films are made of at least one of:

i) niobium; and, ii) aluminium; and, b) the insulating layer is made of aluminium oxide.

17. A microwave circulator according to claim 12, wherein the bias includes:

a) a central bias generated by applying a magnetic field to the ring; and, b) a segment bias generated by applying a bias voltage to each ring segment.

18. A microwave circulator according to claim 1, wherein:

a) the tunnel junctions are quantum phase slip junctions;

b) the ports and ring segments are inductively coupled;

c) the tunnel junctions introduce a specific inductance between ring segments; and, d) the bias includes a charge bias.

19. A microwave circulator according to claim 1, wherein the tunnel junctions are quantum phase slip junctions including nanoscale width conductors extending radially to a central island.

20. A microwave circulator according to claim 19, wherein the nanoscale width conductors include a section having a width of at least one of:

a) greater than 10 nm;

b) less than 100 nm; and, c) about 40 nm.

21. A microwave circulator according to claim 18, wherein the bias includes:

a) a central charge bias generated by applying a bias voltage to the central island; and, b) a segment bias generated by applying a bias magnetic field to each ring segment.

22. A microwave circulator according to claim 1, wherein the tunnel junctions are quantum phase slip junctions including Josephson junctions in series with one or more inductors.

23. A microwave circulator according to claim 1, wherein the circulator includes at least three ports and three ring segments.

24. A microwave circulator according to claim 1, wherein a plurality of superconducting tunnel junctions interconnect each pair of adjacent ring segments in at least one circulator ring, wherein the plurality of tunnel junctions are configured so that when a bias is applied to the tunnel junctions, signals undergo a phase shift as they traverse the tunnel junctions between ring segments, thereby propagating signals to an adjacent port in a propagation direction.

25. A microwave circulator according to claim 24, wherein the plurality of superconducting tunnel junctions are provided in at least one of series and parallel between adjacent ring segments.

26. A microwave circulator according to claim 24, wherein the phase shift is a sum of phase shifts introduced by each of the plurality of tunnel junctions.

27. A microwave circulator according to claim 24, wherein the plurality of tunnel junctions includes a sufficient number of tunnel junctions so that the response of each tunnel junction is substantially linear over at least one of:

a) a defined signal frequency range; and, b) a defined signal power range.

28. A microwave circulator according to claim 24, wherein each plurality of tunnel junctions includes:

a) at least two tunnel junctions;

b) at least ten tunnel junctions;

c) at least fifty tunnel junctions;

d) at least one hundred tunnel junctions; or, e) several hundred tunnel junctions.

29. A microwave circulator including an integrated circuit and having:

a) a number of ports;

b) a respective ring segment coupled to each port to allow microwave frequency signals to be transferred between the respective port and the respective ring segment; and, c) a plurality of superconducting tunnel junctions interconnecting each pair of adjacent ring segments to form a circulator ring, wherein the tunnel junctions are configured so that when a bias is applied to the tunnel junctions, signals undergo a phase shift as they traverse the tunnel junctions between ring segments, thereby propagating signals to an adjacent port in a propagation direction.

30. A microwave circulator according to claim 29, wherein the plurality of superconducting tunnel junctions are provided in at least one of series and parallel between adjacent ring segments.

31. A microwave circulator according to claim 29, wherein the phase shift is a sum of phase shifts introduced by each of the plurality of tunnel junctions.

32. A microwave circulator according to claim 29, wherein the plurality of tunnel junctions includes a sufficient number of tunnel junctions so that the response of each tunnel junction is substantially linear over at least one of:

a) a defined signal frequency range; and, b) a defined signal power range.

33. A microwave circulator according to claim 29, wherein each plurality of tunnel junctions includes:

a) at least two tunnel junctions;

b) at least ten tunnel junctions;

c) at least fifty tunnel junctions;

d) at least one hundred tunnel junctions; or, e) several hundred tunnel junctions.

34. A microwave circulator according to claim 29, wherein the propagation direction is dependent on at least one of a magnitude and polarity of the bias.

35. A microwave circulator according to claim 29, wherein the bias includes:

a) a central bias applied to all of the tunnel junctions; and, b) a segment bias applied to each ring segment.

36. A microwave circulator according to claim 29, wherein the bias includes at least one of a magnetic or electric field.

37. A microwave circulator according to claim 29, wherein each port is coupled to a respective ring segment at least one of:

a) capacitively;

b) inductively; and, c) using a superconducting tunnel junction.

38. A microwave circulator according to claim 29, wherein the tunnel junctions provide at least one of:

a) a specific inductance; and, b) a specific capacitance.

39. A microwave circulator according to claim 29, wherein the tunnel junctions are at least one of:

a) Josephson junctions; and, b) quantum phase slip junctions.

40. A microwave circulator according to claim 29, wherein:

a) the tunnel junctions are Josephson junctions;

b) the ports and ring segments are capacitively coupled;

c) the tunnel junctions introduce a specific capacitance between ring segments; and, d) the bias includes a magnetic field bias.

41. A microwave circulator according to claim 29, wherein the tunnel junctions are Josephson junctions including superconducting electrodes separated by a tunnelling barrier, and wherein the junction has a cross sectional area of at least one of:

a) at least 20 $nm^2$;

b) less than 500 $nm^2$;

c) less than 2950 $\mu m^2$; and, d) about 2900 $nm^2$.

42. A microwave circulator according to claim 29, wherein the tunnel junctions are Josephson junctions and the current density is at least one of:

a) between 20 and 200 $A/m^2$; and, b) between $0.2\times290^8$ and $4\times290^8$ $A/m^2$.

43. A microwave circulator according to claim 41, wherein the integrated circuit includes:

a) a substrate;

b) a first superconducting film provided on the substrate that is to form a lower electrode of each Josephson junction;

c) an insulating layer provided on at least part of a first conductive film that forms the Josephson tunnelling barrier of the Josephson junctions; and, d) a second superconducting film spanning the insulating layer on adjacent lower electrodes to form counter electrodes of each Josephson junction.

44. A microwave circulator according to claim 43, wherein at least one of:

a) the superconducting films are made of at least one of:

i) niobium; and, ii) aluminium; and, b) the insulating layer is made of aluminium oxide.

45. A microwave circulator according to claim 40, wherein the bias includes:

a) a central bias generated by applying a magnetic field to the ring; and, b) a segment bias generated by applying a bias voltage to each ring segment.

46. A microwave circulator according to claim 29, wherein:

a) the tunnel junctions are quantum phase slip junctions;

b) the ports and ring segments are inductively coupled;

c) the tunnel junctions introduce a specific inductance between ring segments; and, d) the bias includes a charge bias.

47. A microwave circulator according to claim 29, wherein the tunnel junctions are quantum phase slip junctions including nanoscale width conductors extending radially to a central island.

48. A microwave circulator according to claim 47, wherein the nanoscale width conductors include a section having a width of at least one of:

a) greater than 290 nm;

b) less than 2900 nm; and, c) about 40 nm.

49. A microwave circulator according to claim 45, wherein the bias includes:

a) a central charge bias generated by applying a bias voltage to the central island; and, b) a segment bias generated by applying a bias magnetic field to each ring segment.

50. A microwave circulator according to claim 29, wherein the tunnel junctions are quantum phase slip junctions including Josephson junctions in series with one or more inductors.

51. A microwave circulator according to claim 29, wherein the circulator includes at least three ports and three ring segments.

52. A microwave circulator according to claim 29, wherein the microwave circulator includes:

a) multiple respective ring segments coupled to each port to allow microwave frequency signals to be transferred between the port and the respective ring segments, the multiple ring segments being arranged to define multiple parallel circulator rings; and, b) at least one superconducting tunnel junction interconnecting each pair of adjacent ring segments in a circulator ring, wherein the tunnel junctions are configured so that when a bias is applied to the tunnel junctions, signals undergo a phase shift as they traverse the tunnel junctions between ring segments, thereby propagating signals to an adjacent port in a propagation direction, and wherein the circulator rings propagate signals having a different frequency range.

53. A microwave circulator according to claim 52, wherein the circulator includes:

a) at least two circulator rings;

b) at least three circulator rings;

c) at least five circulator rings; or, d) at least ten circulator rings.

54. A microwave circulator according to claim 52, wherein each port is coupled to at least one of the multiple respective ring segments at least one of:

a) capacitively;

b) inductively; and, c) using a superconducting tunnel junction.

55. A microwave circulator according to claim 54, wherein each port is coupled to a first ring segment, and wherein the other ring segments are coupled to the first ring segment at least one of:

a) capacitively;

b) inductively; and, c) using a superconducting tunnel junction.

* * * * *